United States Patent [19]

Skifano et al.

[11] 4,255,127

[45] Mar. 10, 1981

[54] SKID RAIL INSULATION MEMBER AND METHOD OF INSTALLING SAME

[75] Inventors: Anthony J. Skifano, Des Plaines, Ill.; Melvin L. Bouts, Oak Hill, Ohio

[73] Assignee: Plibrico Company, Chicago, Ill.

[21] Appl. No.: 62,324

[22] Filed: Jul. 31, 1979

[51] Int. Cl.[3] ..... F27D 1/16; F27D 3/02

[52] U.S. Cl. ..... 432/3; 138/147; 432/234

[58] Field of Search ..... 432/3, 234; 138/147

[56] References Cited

U.S. PATENT DOCUMENTS

| | | | |
|---|---|---|---|
| 3,168,297 | 2/1965 | Brough | 432/234 |
| 3,804,585 | 4/1974 | Twort | 432/234 |
| 3,976,286 | 8/1976 | Thompson et al. | 138/147 |
| 4,134,721 | 1/1979 | Davis et al. | 432/234 |

*Primary Examiner*—John J. Camby

*Attorney, Agent, or Firm*—Emrich, Root, Lee, Brown & Hill

[57] ABSTRACT

A precast insulating material member for insulating a furnace skid rail includes a precast insulating material portion containing a crisscross reinforcing structure. The crisscross reinforcing structure is comprised of a pair of arcuate-shaped rods which are welded together intermediate their ends, each rod having end-eye portions which extend outwardly from the corners of the U-shaped precast insulating member. Positioned about the crisscross-shaped rods are coil members which assist in reinforcing the insulating portion of the member when the reinforcing structure is embedded within the insulating portion. The end-eye portions of the rods provide a mechanical lock of the insulating member to a skid rail pipe when the eye portions are moved into engagement with the outer surface of the skid rail pipe. The method of affixing the precast insulating member to a skid pipe includes the steps of; positioning the precast insulating member having exposed rod end-eye portions about the skid pipe, bending the exposed end-eye portions into engagement with the outer surface of the skid pipe to provide a mechanical lock of the insulating member to the pipe and filing the exposed surface of the pipe with a pliable insulating material to insulate and seal the skid pipe.

8 Claims, 6 Drawing Figures

SKID RAIL INSULATION MEMBER AND METHOD OF INSTALLING SAME

BACKGROUND OF THE INVENTION

Within the past several years, the development of the precast insulating material members has become prominent to provide insulation for furnace skid rail pipes for furnaces such as heating furnaces utilized in the iron and steel industry. For example, U.S. Pat. No. 3,168,297 describes one form of pipe insulation having coiled reinforcing members embedded within the insulation portion and secured to a pipe by means of tie wires. Because the usage of such reinforcing member structures necessarily requires the insulating material be applied about the furnace pipes in situ, such structures are inoperative for insulating skid rails and are commercially unacceptable. Additionally, U.S. Pat. No. 4,134,721 discloses a further form of a furnace insulation member wherein the member is precast and arcuate-shaped to form at most a semicircle structure which may be applied to the skid rail pipe. Additionally, because the precast member includes only reinforcing coil and rod extensions embedded at the ends thereof, such precast members have been found unacceptable as insulation members for covering skid rail pipes because of improper attachment of the member to the skid.

The present invention overcomes the difficulties of the prior art insulating members and provides for a precast insulating material member which can be used for insulating a skid rail pipe.

SUMMARY OF THE INVENTION

It is one object of the present invention to provide a precast insulating material member having a crisscross reinforcing structure embedded therein to provide a single-acting reinforcement material for application as a skid pipe insulating member.

It is a further object of the present invention to provide a precast insulating material member having a combined coil rod and crisscross structure positioned within the insulating portion and extending outwardly from the corners thereof for attachment to a skid pipe having a rub rail mounted thereon.

It is still another object of the present invention to provide a U-shaped precast insulating material member which is adapted to be positioned about a skid rail pipe and mechanically locked in place by bending the end-eye portions of the reinforcing structural member into engagement with the skid pipe.

It is another object of the present invention to provide a precast reinforced insulating member having greater structural stability than the precast insulating material itself.

It is yet a further object of the present invention to provide a precast U-shaped insulating material member having superior mechanical and fusion locking properties when mounted about a skid pipe.

And it is still a further object of the present invention to provide a method of affixing a precast insulating member having a crisscrossed reinforced structure embedded therein to a skid pipe.

In accordance with the present invention a pair of V-shaped rods are spot welded together intermediate their ends thereof to provide a support frame having a geneal crisscross structural configuration. The end portions of each of the rods have preformed thereon eyebolts which extend in a plane which is substantially parallel to the plane of the surface of the skid pipe to which it is to be attached. After the V-shaped rods are spot welded together to provide the crisscross structure, a first coil or spring is inserted over one end thereof and wound diagonally around the one end member of the rod through the spot weld junction to the oppositely facing end portion of the adjacent V-shaped rod. Additionally, a second coil or spring is wound upon the end of the opposite end of the first V-shaped rod past the spot weld juncture of the two V-shaped rods until the second coil extends substantially across in a crisscross fashion to provide the reinforcing structure of the precast insulating material member, as will hereinafter be described.

The resultant crisscross coil and rod structure, arcuate-shaped and adapted to extend substantially about the outer surface of a skid rail pipe when encircling the same, is embedded within an insulating material to provide a precast U-shaped reinforced insulating member. The U-shaped member includes leg extensions having portions of the leg extensions broken away at the corners thereof to permit the end-eye portions of the crisscrossed rods to extend outwardly therefrom in a plane which is substantially parallel to the plane of the surface of the skid pipe to which it will be attached. Also, in the preferred embodiment, leg extensions of the U-shaped reinforced insulating member are of sufficient length that when they are moved into engagement with the surface of the skid pipe, substantially the entire surface of the skid rail pipe, with the exception of the portion having the rub rail mounted thereon, is positioned within the end extremities of the leg extensions of the U-shaped reinforced insulating member.

Additionally, when the U-shaped reinforced insulating member has been positioned about the skid rail pipe, the end-eye portions of the crisscrossed rods are of a sufficient predetermined length such that when the end-eye portions are moved into contact with the outer surface of the skid rail pipe, substantially the entire outer surface of the pipe, with the exception of the rub rail portion, is in engagement with the end-eye portion of the rods and the inner surface of the insulating member to provide a mechanical locking of the reinforced insulating member to the skid rail pipe. In many applications this mechanical locking is of sufficient strength to retain the reinforced insulating member to the skid rail. However, in heavy duty operations where the rub rail portion of the skid rail pipe encounters heavy usage, it is desirous to spot weld the end-eye portions of the rod directly to the surface of the skid rail pipe and, in addition, to spot weld a plug of welding material to the surface of the skid pipe within the area defined by the eye of the end portion of each of the rods. Such practices permanently affix the reinforced insulating member to the skid pipe by providing a fusion locking of the member to the skid rail pipe.

After the mechanical and fusion locking of the insulating member to the rail pipe has been accomplished, an insulating closure material is hammered or compressed into engagement with a portion of the rub rail, the end-eye portions of the rods and the end portions of the leg extensions of the insulating member to provide a keying lock action between the closure insulating material and the U-shaped insulating member affixed about the skid pipe to retain the closure insulating material to the rub rail and the end portions of the U-shaped insulating material to seal and insulate the same. Thus, it has been determined that the unique structure of the U-shaped insulating member, having predetermined lengths of reinforcing rod which are adapted to be bent and substantially engaged to the outer surface of the portion of the skid pipe, permits both a mechanical locking and a fusion locking of the U-shaped insulating member to the skid pipe as well as permitting a keying locking action between the retaining closure insulating material and the U-shaped insulating member.

Furthermore, the crisscrossed spring and rod structure provides a single-acting reinforced insulating member which has heretofore been unknown in the prior art. Also, a combined coil and rod integral crisscross reinforcement structure, when affixed to a skid pipe, retains the precast insulating material about the skid pipe even though the insulating material may be cracked and provides an additional strength to the insulating member in addition to the structural strength of the insulating material alone.

Additionally, the reinforced U-shaped insulating member provides a structure which may be mechanically locked to the surface of a skid pipe, a structure which has heretofore been unknown in the prior art insulating structures.

DETAILED DESCRIPTION

Figure 1:
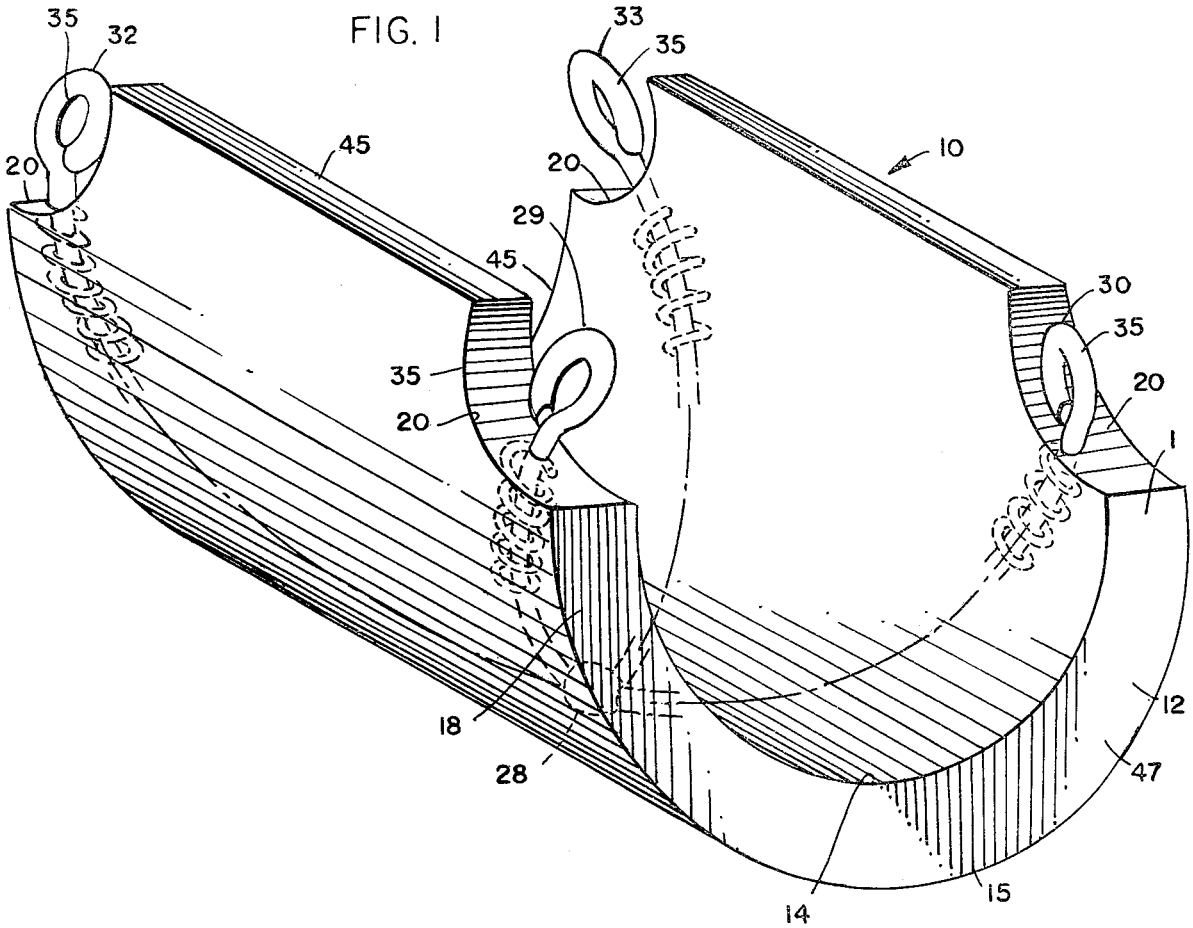
FIG. 1 is a perspective view of the reinforced insulating member in accordance with the present invention.

Referring now to the drawings wherein like numerals have been used through the several views to designate the same or similar parts, FIG. 1 illustrates a precast insulating material member 10 in accordance with one embodiment of the present invention. The reinforced material member 10 is comprised of a body of insulating material 12 having an inner U-shaped surface 14 and an outer U-shaped surface 15. The member 10 includes also a pair of leg extensions 17 and 18 (FIG. 2) which include a plurality of recessed corners 20 formed therein. Importantly, the precast U-shaped reinforced member 10 is reinforced with a crisscross structure which is comprised of a pair of V-shaped rods 24 and 26 (FIG. 4) which are spot welded together at point 28 intermediate the ends 29 and 30 of rod 24 and ends 32 and 33 of rod 26, respectively. The end portions 29-30 and 32-33 of each of the rods 24 and 26 may have preformed thereon eyebolts 35 which extend in a plane which is substantially parallel to the plane of the surface of the skid pipe 40 to which it is to be attached. After the V-shaped rods 24 and 26 are spot welded together to provide the crisscross structure (FIG. 4), a first coil or spring 36 is inserted over end portion 29 and eyebolt portion 35 of rod 24 and wound diagonally down the length of rod 24 to the junction of the full strength spot weld 28 wherein the spring 36 is further wound about rod 26 to extend substantially to the end portion 33 of rod 26, a position as shown in FIG. 3. In a similar fashion a second coil or spring 38 is inserted over end portion 30 of rod 24 and wound diagonally down the length of the portion of rod 24 through the spot weld 28 and onto rod portion 26 to extend substantially to the end portion 32 of rod 36. Thus, a crisscross structure 31 (FIG. 4) is provided as a reinforcing structure for the body of the insulating material 12, as will hereinafter be described.

Figure 4:
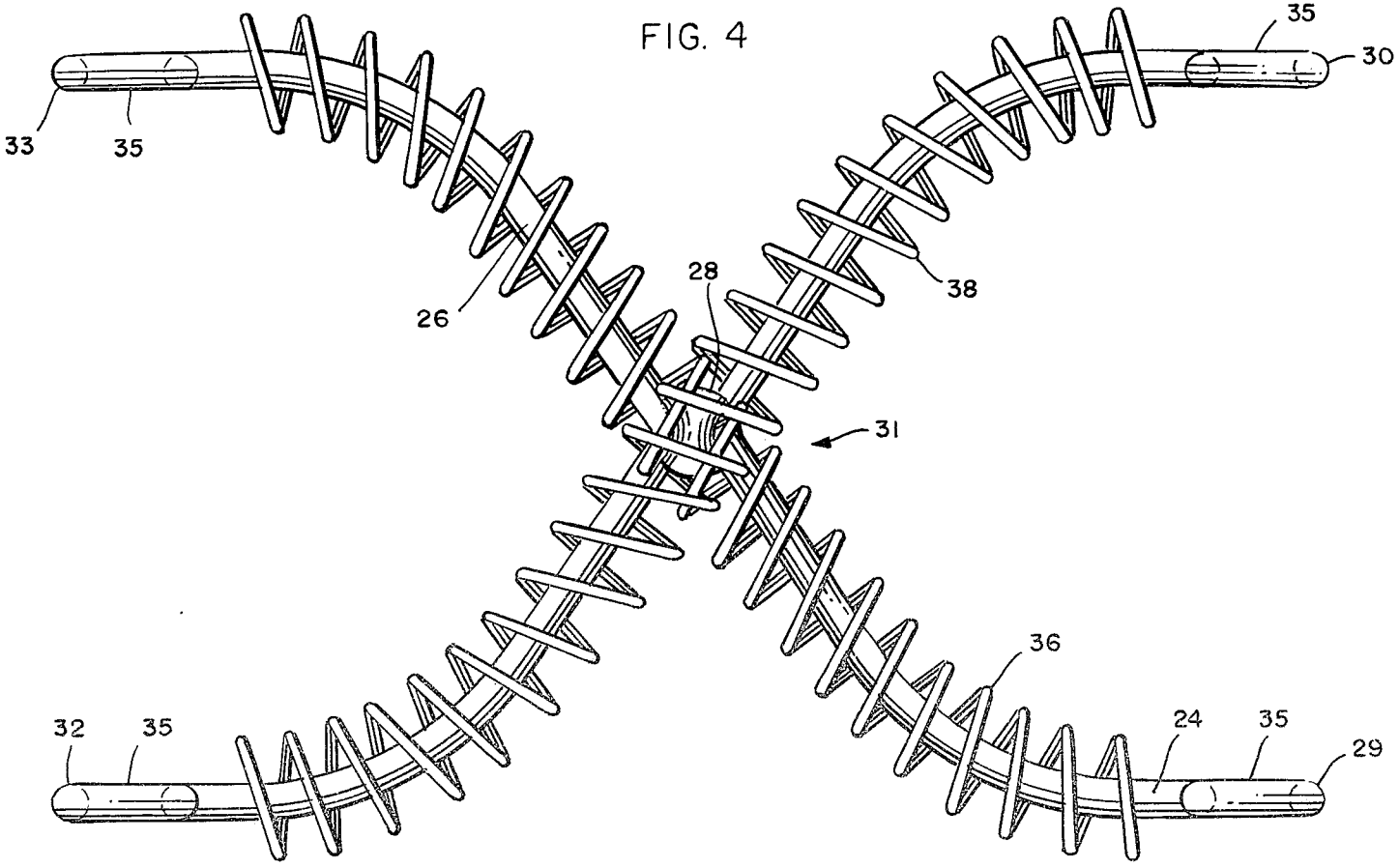
FIG. 4 is a plan view of the reinforcing rod structure in accordance with the present invention showing the spot welding of the V-shaped rod structures showing the crossover of the reinforcing coil spring before molding of the insulating material about the reinforcing structure.

Additionally it should be pointed out that it is within the scope of the present disclosure that the crisscrossed reinforcing structure 31 could be obtained by spot welding together a pair of elongated semicircular helical rods intermediate their ends. Then, first and second coils are wound about the rods to provide a similar crisscross structure, as has been described above. However, in this embodiment, the crisscross structure would not be comprised of two individually V-shaped rods 24 and 26, as shown in FIG. 4, but rather two elongated helical semicircular rods (not shown) which have been joined together intermediate their ends thereof.

When the resultant crisscrossed coil and rod structure 31 has been completed, the structure is embedded within the insulating material 12 to provide the precast U-shaped reinforced insulating member 10, as is well known in the art. Importantly, the end portions 29 and 30, of rod 24, and 32 and 33, of rod 26, extend outwardly from the formed corners 20 of the precast material member 10 in a plane which is substantially parallel to the plane of the surface of the skid pipe surface 42 of the skid pipe 40, and the ends of the coils 36 and 38 are preferably entirely embedded within the body of insulating member 12 (FIG. 3). Additionally, the leg extensions 17 and 18 of the member 10 are of sufficient length such that when they are moved into engagement about the surface 42 of the skid pipe 40, substantially the entire surface area of the skid rail pipe 40, with the exception of the portion having the rub rail 44, which is conventionally mounted thereon, is positioned within the end surface 22 of leg extension 17 and the end surface 23 of leg extension 18, a position as shown in FIG. 2.

Figure 2:
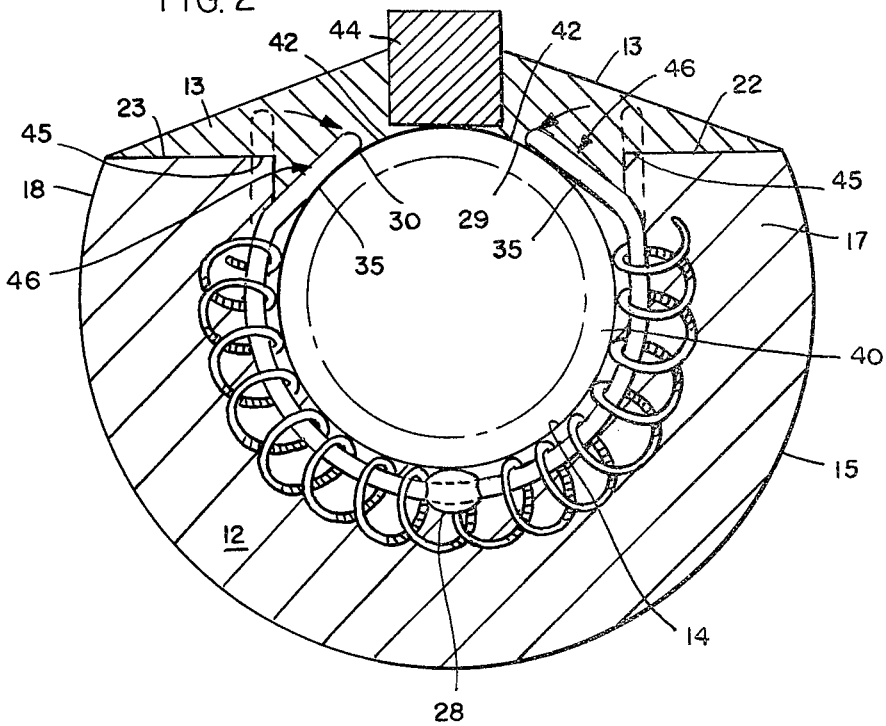
FIG. 2 is a cross sectional diagonal view of the reinforced insulating member installed about a skid rail pipe having a rub rail mounted thereon showing the reinforced crisscross structure in accordance with the present invention.
Figure 3:
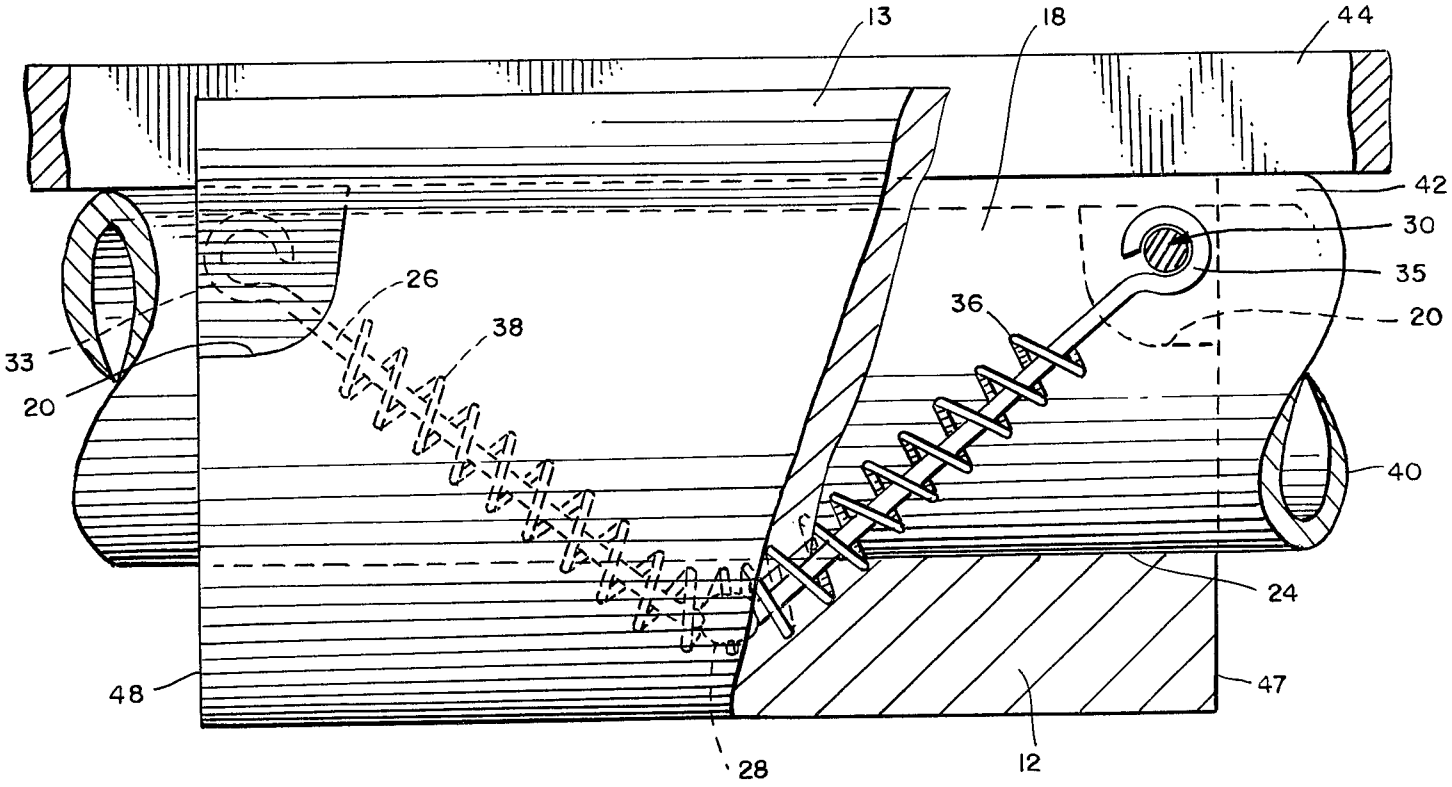
FIG. 3 is a side elevational view of the reinforced insulating member installed about a skid rail pipe having a rub rail mounted thereon showing the reinforced crisscross structure in accordance with the present invention with the parts of the installed reinforced insulating member broken away.
Figure 5:
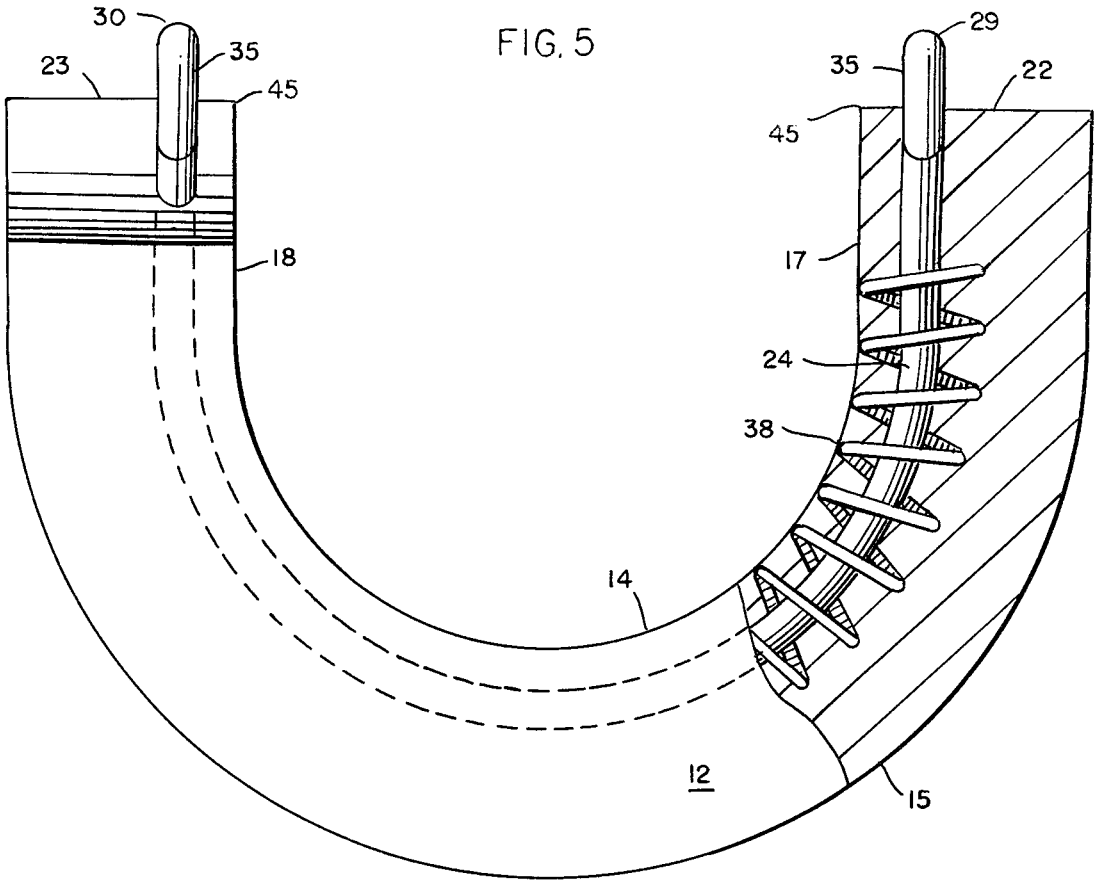
FIG. 5 is an end view of the reinforcing structure of FIG. 4 with the insulation material and pipe in phantom.
Figure 6:
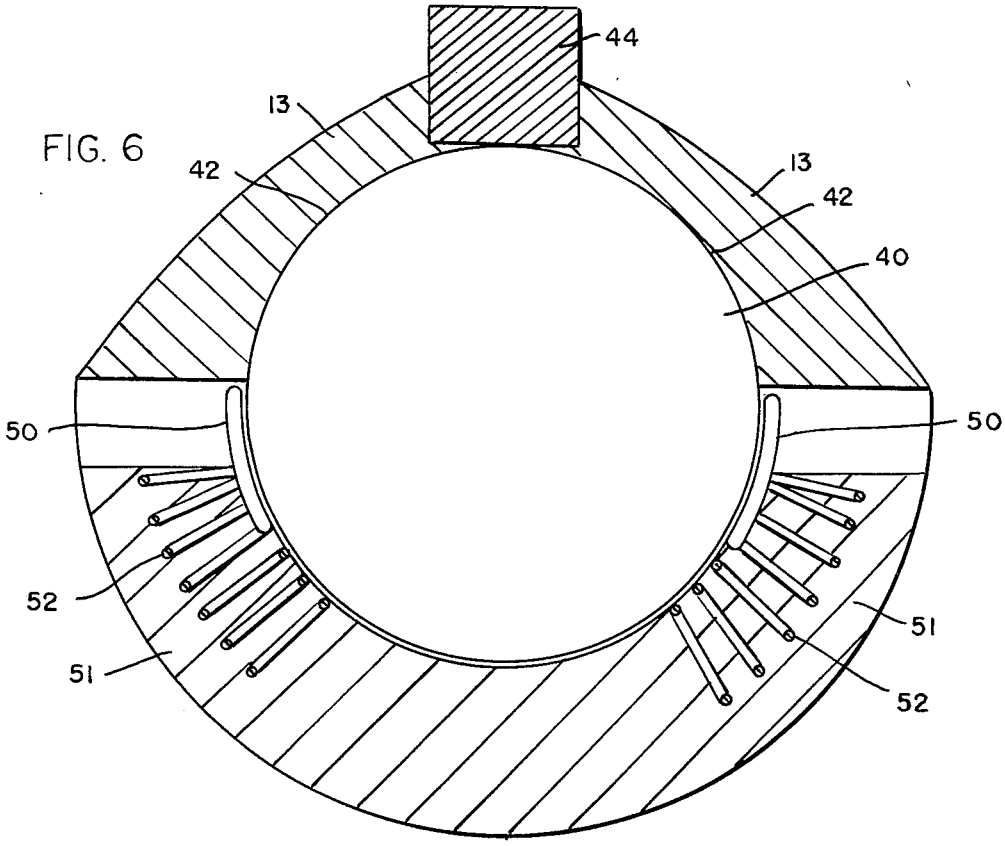
FIG. 6 is an insulating member in accordance with the prior art installed about a skid rail having a rub rail mounted thereon.

Importantly, when the U-shaped insulating member 10 is positioned about a skid rail pipe 40, the rods 24 and 26 and the corresponding end-eye portions are of a sufficient predetermined length such that when the end-eye portions are moved from the vertical position (FIG. 5), into contact with the outer surface 42 of the skid rail pipe 40, a position as shown in FIG. 2, substantially the entire outer surface 42 of pipe with the exception of the rub rail portion 44, is engaged by the end-eye portion of the rods and the inner surface 14 of the insulating member 10 to provide a mechanical locking of the reinforced insulating member 10 to a skid rail pipe 40. However, it is within the scope of the present disclosure to include a member 10 having leg extensions which extend approximately upwardly one-half the diameter of the pipe 40 but which include predetermined length of rods 24 and 26 to mechanically lock the member 10 onto the pipe 40, as has been described. In contradistinction to such a mechanical locking of the insulating member to the skid rail pipe, FIG. 6 is a typical installation in accordance with prior art teachings wherein at most a 180° arcuate reinforced insulating member 51 is mounted to a skid pipe 40. As is readily apparent, the eyebolt portions 50 of the prior art members 51 are only mounted to a few turns of a coil wire 52 and the insulating member must be directly welded onto the surface 42 of the skid pipe to hold the same upon the pipe. Also, it is readily apparent that the coil 52 is positioned only on the ends of the precast material member such that a substantial body portion of the material member 51 is not reinforced.

The present invention provides that the end and eyebolt portions of each of the crisscross structure 31 are mechanically forced into engagement with the outer surface 42 of the skid pipe 40 to provide a mechanical locking which is of sufficient strength to retain the reinforced insulating member 10 to the skid rail pipe. Moreover, in heavy duty operations where the rub rail portion 44 of the skid rail pipe encounters heavy usage, it may be desirous to spot weld the end-eye portions of the crisscross reinforcing structure directly to the surface of the skid rail pipe and, in addition, to spot weld a plug of welding material to the surface of the skid pipe within the area defined by the eye 35 of the end portions of each of the rods 24 and 26, as shown by arrow 46, FIG. 2. Such a practice permanently affixes the insulating member 10 to the skid pipe 40 by providing in addition to the mechanical locking a fusion locking of the member 10 to the skid rail pipe 40, a position as shown in FIG. 2.

After the mechanical and fusion locking of the insulating member 10 to the rail pipe surface 42 has been accomplished, an insulating closure material 13 is hammered or compressed into engagement with a portion of the rub rail 40, the end-eye portion of the rods 24 and 26 and the end surfaces 22 and 23 of the leg extensions 17 and 18, respectively, to provide a keying lock action between the closure insulating material and the end surfaces of the U-shaped insulating member to seal and insulate the same (FIG. 2). However, such a keying lock action between the closure insulating material 13 and the reinforced material member 51, in accordance with the prior art teaching of FIG. 6, does not result because of a substantial amount of surface 42 of the skid pipe 40 that has to be covered and because there is no corner surface 45 coverage possible in the prior art structures.

When it is desired that additional members 10 are mounted to the pipe 40, ends 47 and 48 (FIG. 3) of housing or body of insulation material 12 are positioned adjacent previously mounted members 10, prior to applying closure material to the completed insulation assembly, as set forth above.

What has been described is a unique structure of the U-shaped insulating member having predetermined lengths of reinforcing rod ends which are adapted to be bent and substantially engaged to the outer surface of the portion of the skid pipe, permits both a mechanical locking and a fusion locking of the U-shaped insulating member to the skid pipe as well as permitting a keying locking action between the retaining closure insulating material and the U-shaped insulating member.

Furthermore, the crisscrossed spring and rod structure provides a single-acting insulating member, and a housing structure, having an embedded crisscrossed reinforced structure therein, which retains the precast insulating material about the skid pipe even though the insulating material may be cracked and which provides additional strength to the insulating member in addition to the structural strength of the insulating material alone.

We claim:

1. A precast insulating material member for insulating about a skid rail pipe, including in combination a housing portion of insulating material having recessed corners thereon and adapted to be positioned about a skid rail pipe, a crisscross shaped rod portion and a coil member portion wrapped around said crisscross shaped rod portion, said rod and coil member positioned within said housing portion of insulating material, with said rod portion having end portions extending outwardly from the said recessed corners in said housing portion, and mechanical locking means associated with said end portions of said rod position when the same are engageable with the skid rail pipe to fix the insulating member to the skid rail pipe.

2. The precast insulating member in accordance with claim 1 wherein said housing portion is U-shaped and includes a pair of leg extensions integral thereto.

3. The precast insulating member in accordance with claim 1 wherein said end portions of said rod portion are looped and engageable with the skid rail pipe.

4. The precast insulating member in accordance with claim 3 wherein said precast material member further includes fusion locking means for fusing said looped end portions of said rod portion to the skid rail pipe.

5. The precast insulating member in accordance with claim 2 wherein the length of said pair of leg extensions extends beyond the midpoint of the skid rail pipe.

6. The precast insulating member in accordance with claim 1 wherein when said rod portion and said end portions thereon are engageable with the skid rail pipe, substantially all of the pipe is enclosed by said rod portions and said end portions thereon.

7. The method of affixing a precast insulating member to a skid pipe having a rub rail mounted thereon, including the steps of, positioning a U-shaped precast insulating member, having a crisscrossed shaped rod portion and coil structure portion wrapped around said rod portion within said insulating member with said rod portion having exposed end-eye portions extending outwardly from the insulating member thereon, about a skid pipe, bending the exposed end-eye portions of said rod portion into engagement with the skid pipe to provide a mechanical locking of the insulating member to the pipe, and filling the exposed surface of the pipe with a closure insulating material to insulate and seal the skid pipe.

8. The method of affixing a precast insulating member in accordance with claim 7 further including the step of fusing said end-eye portions of said crisscrossed rod portion structure to the skid pipe, after bending said end-eye portions into engagement with the skid pipe.

* * * * *